US006183341B1

(12) United States Patent
Melcer

(10) Patent No.: US 6,183,341 B1
(45) Date of Patent: Feb. 6, 2001

(54) SLURRY PUMP CONTROL SYSTEM

(75) Inventor: Chris Melcer, San Luis Obispo, CA (US)

(73) Assignee: Strasbaugh, Inc., San Luis Obispo, CA (US)

( * ) Notice: Under 35 U.S.C. 154(b), the term of this patent shall be extended for 0 days.

(21) Appl. No.: 09/248,167

(22) Filed: Feb. 9, 1999

(51) Int. Cl.[7] ..... B24B 51/00

(52) U.S. Cl. ..... 451/5; 451/8; 451/60; 451/99; 451/446

(58) Field of Search ..... 451/5, 8, 60, 67, 451/99, 446

(56) References Cited

U.S. PATENT DOCUMENTS 3,500,591 * 3/1970 Gawronski et al. ..... 451/60 X
3,653,842 * 4/1972 Putman .
4,025,121 5/1977 Kleysteuber et al. .
4,059,929 * 11/1977 Bishop ..... 451/60
4,380,412 4/1983 Walsh ..... 409/314
4,547,128 * 10/1985 Hayes .
5,479,957 * 1/1996 Crow et al. .
5,538,462 * 7/1996 Gnadt ..... 451/60 X
5,540,555 * 7/1996 Corso et al. .
5,616,831 4/1997 Ferland et al. ..... 73/61.63
5,857,893 * 1/1999 Olsen et al. ..... 451/60 X

* cited by examiner

*Primary Examiner*—Timothy V. Eley
(74) *Attorney, Agent, or Firm*—K. David Crockett, Esq.; Crockett & Crockett

(57) ABSTRACT

A CMP slurry pumping system which uses the slurry pump inlet pressure as input to the pump controller, and adjusts pump speed to account for variations in inlet pressure.

4 Claims, 2 Drawing Sheets

SLURRY PUMP CONTROL SYSTEM

FIELD OF THE INVENTIONS

The devices and methods described below relate to the fields of chemical mechanical polishing and control of slurry flow rates. The devices and methods may also be used in the grinding and polishing of wafers for the electronic materials and data storage industries.

BACKGROUND OF THE INVENTIONS

Chemical mechanical polishing (CMP) is a process for very finely polishing surfaces under precisely controlled conditions. In applications such as polishing wafers and integrated circuits, the process is used to remove a few angstroms of material from an integrated circuit layer, removing a precise thickness from the surface and leaving a perfectly flat surface. The surface to be polished may be comprised of many materials, including various metals and silicates.

To perform chemical mechanical polishing, a slurry comprising a suitable abrasive, a chemical agent which enhances the abrasion process, and water is pumped onto a set of polishing pads. The polishing pads are rotated over the surface requiring polishing. The amount of polishing (the thickness removed and the flatness of the finished surface) is controlled by controlling the time spent polishing, the distribution of abrasives in the slurry, the amount of slurry pumped into the polishing pads, and the slurry composition (and other parameters). It is therefore important to control each of these parameters in order to get a predictable and reliable result from the polishing process. In particular, unreliable slurry flow rates cause fluctuations in removal rates and a large number of unacceptable finished wafers or circuits.

The slurry used for polishing is sensitive to degradation by the components in the slurry flow path. Whenever the slurry is subject to shear forces created by intrusive mechanical components such as pump impellers, pressure gauge taps, or flow meter vanes, its abrasive particles have tendency to agglomerate. This agglomeration results in uneven polishing, scratching, and other defects in the polished surface. Accordingly, peristaltic pumps are used to pump the slurry because these pumps have no impellers which impart shear forces to the slurry. However, flow rate is often measured with vaned flow meters or other intrusive and shear creating flow meters which rely of the insertion of physical structures into the slurry flow (any agglomeration is tolerated, and results in lower reliability and yield of the system).

SUMMARY

The peristaltic pumps used in CMP systems typically perform with a linear or near linear relationship between the speed of the pump and the flow rates generated by the pump (the outlet pressure has little effect on pump output volume). This assumes that the pressure of slurry provided to the inlet of the pump is constant. When the inlet pressure varies, the speed of the pump required for a given flow rate changes. Fortunately, the pump speed proportionality constant (which relates flow rate to pump speed) varies linearly, or nearly linearly, with inlet pressure. The flow rate constant, and its relationship to inlet pressure, can be determined empirically for a polishing system. This constant can then be used to control the peristaltic pump to compensate for variations in slurry inlet pressure and provide more constant slurry flow rates to the polishing pads.

The pump speed proportionality constant M (in units of RPM/(ml/min) is derived from equations such as M=slope (inlet pressure)+c. The slope and constant c are derived empirically for a system by measuring the flow rate at various pump speeds for a variety of inlet pressures. The pump speed required to maintain a specified flow rate is governed by the equation RPM=M×Flow rate. Thus, by sensing the inlet pressure of the slurry provided to the slurry pump, the pump speed required for a desired flow rate may be adjusted based upon the slurry inlet pressure (through application of a pump speed proportionality constant which is a function of inlet pressure), thereby isolating the system from slurry flow rate fluctuations caused by slurry inlet pressure fluctuations.

Chemical mechanical polishing systems are manufactured in a variety of configurations. For each system, the pump speed proportionality constant as a function of inlet pressure must be determined. This may be accomplished once for a line of CMP systems manufactured to the same specifications, or it may be done on every unit. To use the measured pump speed proportionality constant curve, the peristaltic pump inlet piping is fitted with an inlet pressure sensor and the pump motor is provided with an encoder to monitor pump speed. The pump controller is provided with a computer and software programmed to take input from the pressure sensor and the motor encoder, and receive operator input regarding the user's desired slurry output flow rates and the proportionality constant curve. The computer is programmed to calculate the pump speed required to maintain the specified output flow rate given the sensed inputs, and to control the pump accordingly to maintain the desired output flow rate.

DETAILED DESCRIPTION OF THE INVENTIONS

Figure 1:
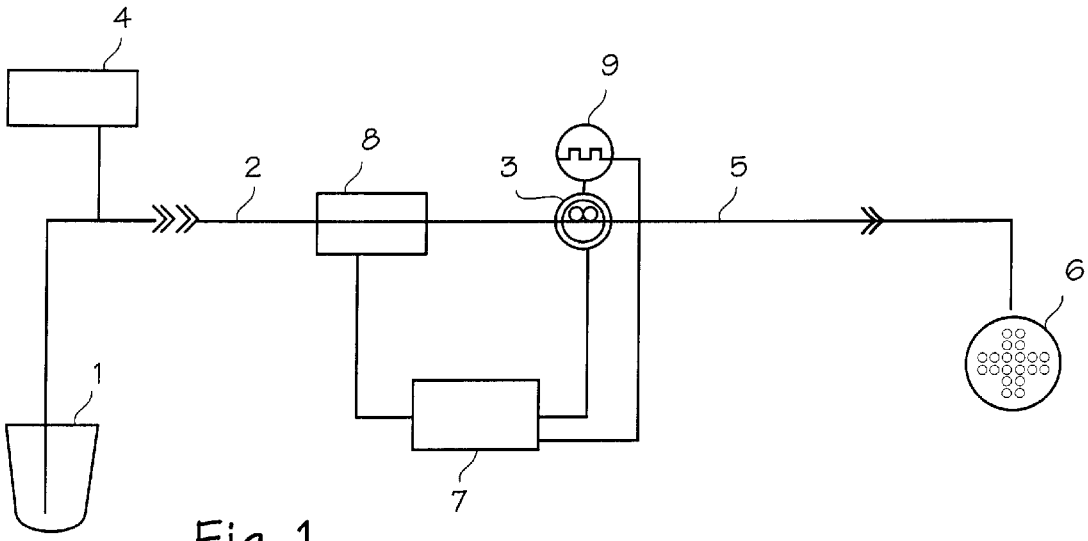
FIG. 1 is a schematic flow diagram of the slurry supply pumping system.

FIG. 1 illustrates the elements of a slurry supply system modified to monitor pump inlet pressure and use the sensed pressure to control the pump (pump speed feedback is also used). The slurry supply tank 1 provides pressurized slurry to the slurry supply inlet piping 2 of the motor operated slurry pump 3 (the pump may also be supplied by a de-ionized water source 4 for supply of pure water, or by both a slurry source and a de-ionized water supply.). The pump outlet 5 provides slurry onto the polishing pad assembly 6. The slurry pump is controlled by the pump controller 7. On the inlet piping, a pressure sensor 8 senses the pressure of the slurry (or whatever fluid is required) in the inlet to the pump and sends corresponding electrical signals representative of the slurry pump inlet pressure to the pump controller 7. The pump controller may be set by an operator to maintain a specified flow rate, in the range of 0–500 ml/min. The pump controller uses the specified flow rate, the sensed inlet supply pressure, and known relationship between the pump speed and volume output to compute the required pump speed. The controller adjusts the voltage applied to the pump motor to attain the required pump speed. The pump motor speed is monitored by the encoder 9 which senses the speed of the pump or its motor and transmits a corresponding signal representative of the pump speed to the pump controller. The pump controller adjusts its output to drive the motor accordingly. In this manner, the slurry pump output volume may be maintained nearly constant despite significant variations in slurry inlet pressure.

The components of FIG. 1 are preferably chosen for their non-intrusive characteristics which have the lowest possible detrimental effect on the slurry. The pump 3 is preferably a peristaltic pump such as a Barant model MR-07016-21. The pressure sensor 8 is preferably a non-intrusive pressure transducer, such as a pipe wall strain sensor (NT model 4210 flow through pressure transducer) or other flow through pressure transducer. These components do not make use of parts disposed within the slurry stream, and are therefore less likely to alter the particle size distribution, encourage agglomeration and uneven distribution of slurry onto the polishing pads. The pump controller is preferably an MEI Motion Controller Dsppro-scr-8 with a MEI Cable Interface stc-d50, and a Minarik Motor Drive MM03-115AC PCM-0613.

Figure 2:
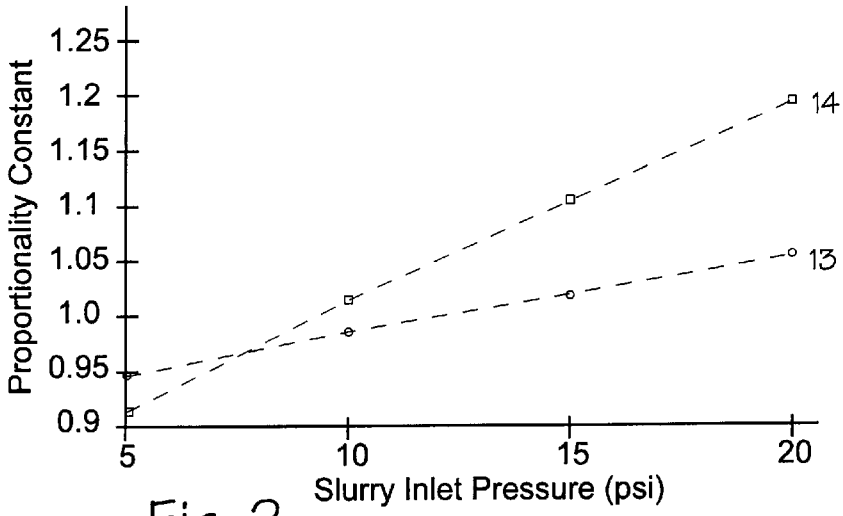
FIG. 2 is a graph of the proportionality constant as a function of inlet pressure for two systems.
Figure 3:
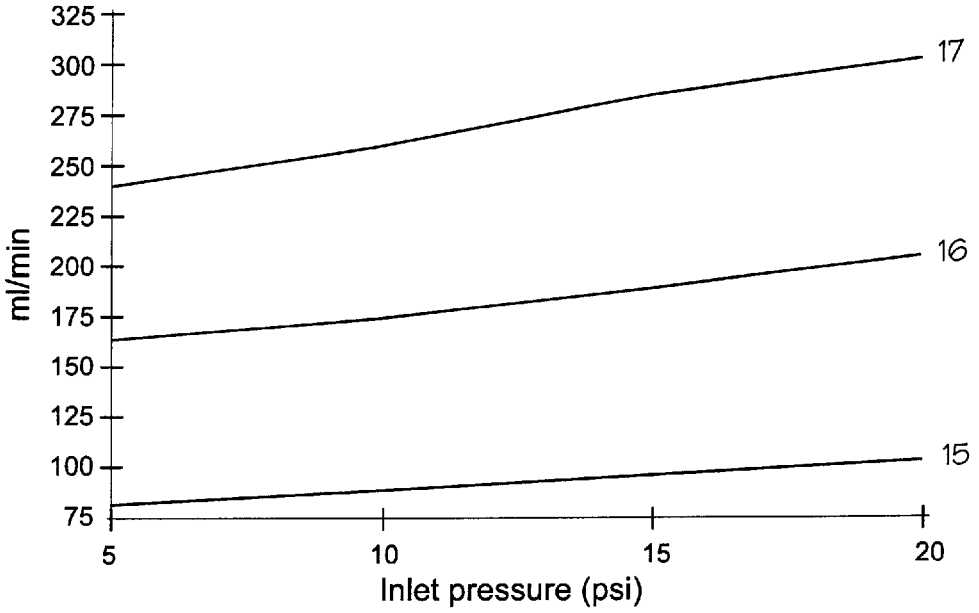
FIG. 3 is a graph of slurry flow rate as a function of inlet pressure for several pump speeds in an uncorrected system.
Figure 4:
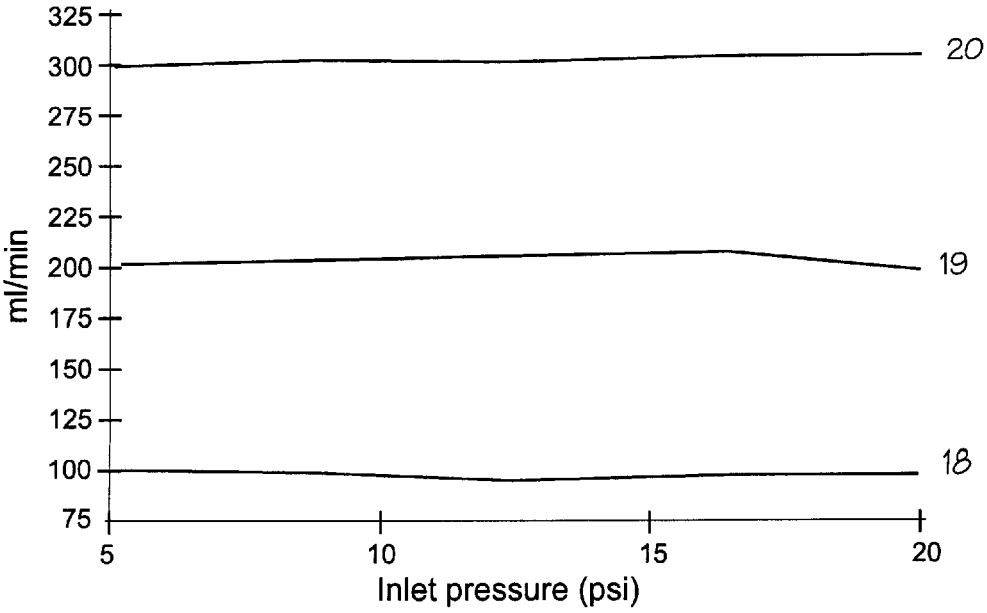
FIG. 4 is a graph of slurry flow rate as a function of inlet pressure for several pump speeds, where the pump speed is corrected based on measured inlet pressure.

FIGS. 2, 3 and 4 illustrate the method of determining the method by which the pump controller determines the desired pump speed. The method applies to a single polishing system, but may be extrapolated to apply to entire model lines of polishing systems. Thus, a representative polishing system having a specified slurry supply configuration may be measured, and the empirically derived control equations applied to every system built to the same specifications. Referring the FIG. 2, various measurements of inlet pressure and proportionality constant are obtained to determine the curves shown in the Figure. The upper curve 13 corresponds to a system configured with a relatively low durometer tubing material (of approximate durometer value 60–70) while the lower curve 14 corresponds to a system configured with a relatively high durometer tubing material (of approximate durometer value 70–100). The chart of FIG. 2 illustrates that the proportionality constant varies essentially linearly with inlet pressure, and that the proportionality constant is different for each slurry supply system. The curves are linear, or so nearly linear that they can be approximated by a straight line. Referring to the upper curve 13, analysis of the curve indicates that the proportionality constant is defined by the equation Proportionality constant= 0.0189(inlet pressure)+0.8188. Referring to the lower curve 14, analysis of the curve indicates that the proportionality constant is defined by the equation Proportionality constant= 0.0073(inlet pressure)+0.9115. This illustrates the need to determine the values of the slope and constant of the pump speed proportionality requirement empirically (by taking measurements of the system).

FIG. 3 illustrates the empirically determined relationship between flow rate and inlet pressure without correction for variation in inlet pressure. The curves correspond to the system measured on lower curve 14 in FIG. 2. The curve 15 represents measurements taken with the slurry pump running at about 60–120 rpm, the curve 16 represents measurements taken with the slurry pump running at about 170–230 rpm, and the curve 17 represents measurements taken with the slurry pump running at about 260–320 rpm. As appears clearly from the graph, slurry flow rate varies significantly with variations in the pressure of the slurry supply to the slurry pump.

FIG. 4 illustrates the slurry flow rate as a function of inlet pressure for several pump speeds, where the pump speed is corrected based on measured inlet pressure. Having determined that the proportionality constant is related to the slurry inlet pressure by the equation Proportionality constant=0.0073(inlet pressure)+0.8188, the pump speed is adjusted according to the equation RPM=M×Flow rate, or, equivalently RPM=(slope(inlet pressure)+c)×Flow rate. Applying the numbers derived empirically from FIG. 2, the applicable equation is RPM=(0.0073(inlet pressure)+ 0.8188)×Flow rate. The pump controller includes a computer which accepts operator input regarding the desired slurry flow rate, accepts the signal from the slurry inlet pressure sensor, and computes the required pump RPM. The controller then controls the pump to maintain this speed. Inlet pressure is monitored periodically and adjustments to pump speed are made periodically. The pump speed is measured through the motor encoder, and the controller adjusts the control signals to maintain the calculated pump speed. As illustrated in FIG. 4, the curve 18 represents measurements taken with the slurry pump running at about 60 rpm, the curve 19 represents measurements taken with the slurry pump running at about 170 rpm, and the curve 20 represents measurements taken with the slurry pump running at about 260 rpm. The variation in output volume due to fluctuation in inlet pressure has been greatly reduced. Maximum variations in this embodiment were reduced from 16% without adjustment for inlet pressure variations to 2.5% while employing the system which adjusts pump speed for variations in inlet pressure.

It is expected that the methods and devices described above be implemented on a variety of chemical mechanical polishing systems, each having different configurations requiring determination of the appropriate equations relating pump speed to desired output. The methods may be performed with alternative means for calculating the required pump speed, such as look up tables stored in computer memory to which the pump controller refers to set pump speed. Additionally, the necessary equations can be stored and embodied in circuitry, with circuit parameters adjusted to accomplish the conversion between inlet pressure and desired pump speed. Where the pump speed proportionality constant curves are not linear, as may be the case for some systems, the information relating the proportionality constant to inlet pressure may be approximated by linear equations or stored as precisely as possible in look up tables. Thus, while the preferred embodiments of the devices and methods have been described in reference to the environment in which they were developed, they are merely illustrative of the principles of the inventions. Other embodiments and configurations may be devised without departing from the spirit of the inventions and the scope of the appended claims.

I claim:

1. A system for pumping slurry from a slurry source to a polishing pad in a chemical mechanical polishing system comprising:

a peristaltic pump having an inlet and an outlet;

a controller for controlling the speed at which the pump operates;

a slurry supply line communicating with the inlet of the pump;

a slurry output line in fluid communication with the outlet of the pump, said output line aligned to provide slurry to the polishing pad;

a pressure sensor operably connected to the slurry supply line, said pressure sensor capable of sensing the pressure in the supply line and transmitting a pressure signal indicative of the pressure in the supply line to the controller;

said controller being programmed to accept the pressure signal indicative of the pressure in the supply line, to accept input from an operator regarding the desired output flow rate of the pump, and to calculate the pump speed required to provide the desired output based on the pressure in the supply line, and maintain the pump speed at the calculated pump speed.

2. The device of claim 1 wherein the pressure sensor is a non-intrusive pressure sensor which senses pressure in the slurry supply line without placing any structure in the slurry flow.

3. The device of claim 1 wherein the controller is programmed to calculate the pump speed required to provide the desired output based on the equation RPM=M×desired output, where RPM is the pump speed and M is the pump speed proportionality constant.

4. The device of claim 3 wherein the slurry supply line supplies slurry to the inlet of the pump at a measurable inlet pressure and the pump speed proportionality constant M is calculated based on the equation M=slope(inlet pressure)+c, where the value of the slope and c in the equation are empirically determined through testing of the system.

* * * * *